United States Patent [19]

Anderson

[11] Patent Number: 4,532,872

[45] Date of Patent: Aug. 6, 1985

[54] CHAR REINJECTION SYSTEM FOR BARK FIRED FURNACE

[75] Inventor: David K. Anderson, East Longmeadow, Mass.

[73] Assignee: Combustion Engineering, Inc., Windsor, Conn.

[21] Appl. No.: 682,442

[22] Filed: Dec. 17, 1984

[51] Int. Cl.[3] ..... F23G 5/12

[52] U.S. Cl. ..... 110/255; 110/245; 110/293; 110/267; 110/248; 110/269; 110/270

[58] Field of Search ..... 110/245, 267, 105, 269, 110/270, 255, 248, 293; 432/99

[56] References Cited

U.S. PATENT DOCUMENTS

| | | | |
|---|---|---|---|
| 3,173,389 | 3/1965 | Cates, Jr. et al. | 110/255 |
| 3,584,587 | 6/1971 | Siracusa | 110/255 |
| 4,263,857 | 4/1981 | Ban | 110/270 |
| 4,325,310 | 4/1982 | Babbage | 110/267 |
| 4,434,724 | 3/1984 | Kunkel, Jr. | 110/267 |
| 4,476,790 | 10/1984 | Borio et al. | 110/245 |
| 4,477,251 | 10/1984 | Cosar et al. | 110/245 |
| 4,481,892 | 11/1984 | Mah | 110/245 |

*Primary Examiner*—Henry C. Yuen

*Attorney, Agent, or Firm*—Robert L. Olson

[57] ABSTRACT

A furnace (10) in which bark or other cellulosic fuel (64) is burned on a traveling grate (24). Char (62) separated (48, 54) from the furnace exhaust gases is reinjected into the furnace beneath baffle plate (40) in such a manner that the raw bark (64) being introduced onto the grate forms a protective cover over the char (62) thus preventing the relatively light char particles from becoming reentrained in the gases before they are completely combusted.

1 Claim, 1 Drawing Figure

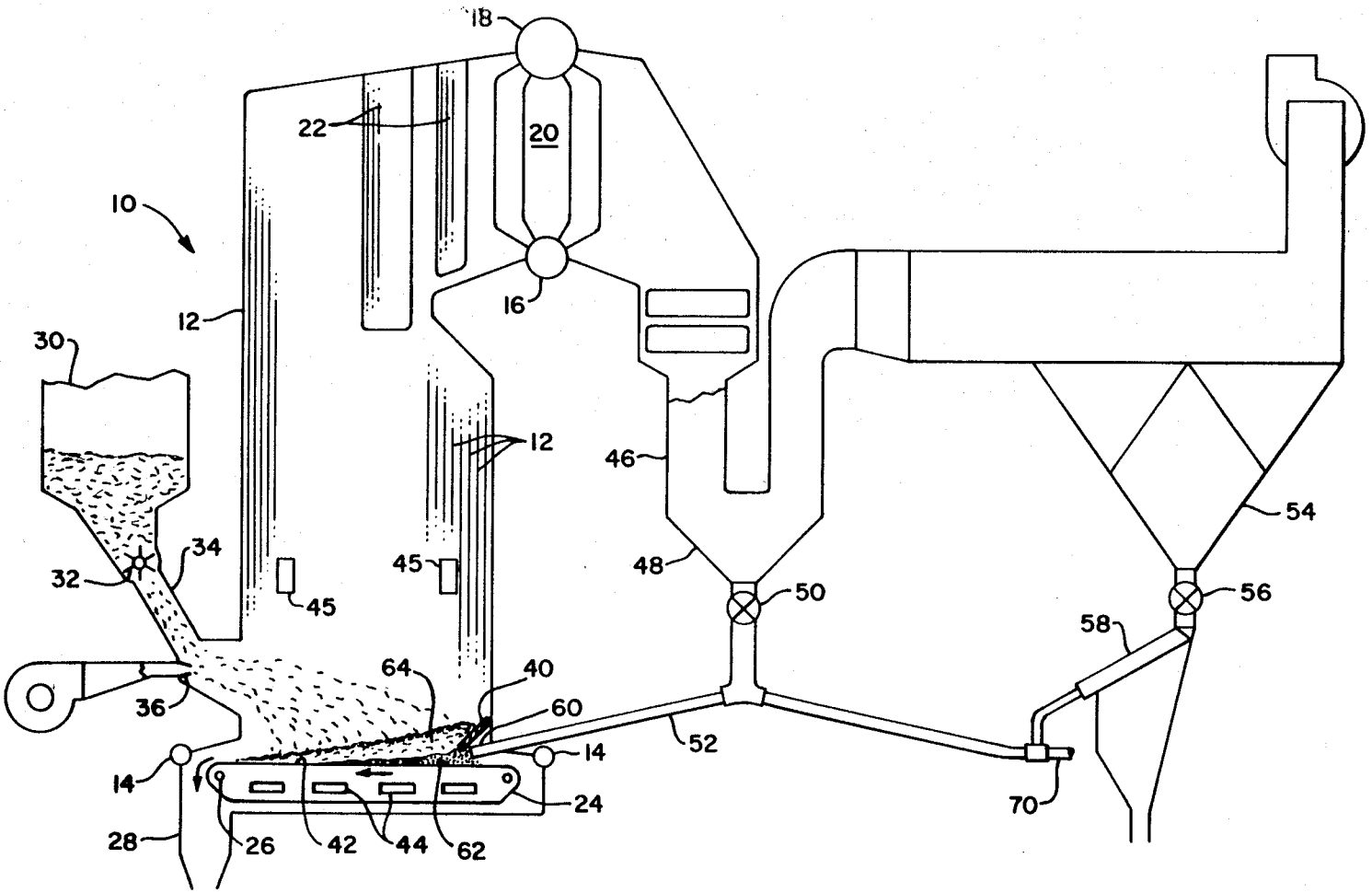
10
12
14
16
18
20
22
24
26
28
30
32
34
36
40
42
44
45
46
48
50
52
54
56
58
60
62
64
70

CHAR REINJECTION SYSTEM FOR BARK FIRED FURNACE

BACKGROUND OF THE INVENTION

In present day bark or other cellulosic fuel fired furnaces, unburned carbon in the form of char is removed from the flue gas stream and reinjected back into the furnace to be burned. These char particles have a very low density (approximately two-tenths gram/cc), and thus they are quickly reentrained by the air that flows up through the traveling grate stoker and are again carried out of the furnace.

SUMMARY OF THE INVENTION

In accordance with the present invention, apparatus is provided to assure the complete combustion of the char particles reinjected into the furnace. This is accomplished by introducing the reinjected char onto the traveling grate stoker at a location underneath a protective deflector plate. This causes the new raw fuel to be deposited on top of the char, so that the reinjected char can not be easily reentrained and hence will undergo complete combustion. This will result in higher overall plant efficiency.

BRIEF DESCRIPTION OF THE DRAWING

The Figure is a sectional side view of a traveling grate furnace incorporating the baffle arrangement of the invention.

DESCRIPTION OF THE PREFERRED EMBODIMENT

Looking now to the drawing, numeral 10 depicts a furnace in which bark or other cellulosic fuel is burned. The furnace is lined with water-cooled tubes 12 which are supplied by headers 14. The headers receive water from the lower drum 16 through downcomers (not shown). A mixture of steam and water exits from the upper ends of tubes 12 into upper drum 18. Steam is also generated in the boiler section 20 of the unit. The steam passes from drum 18 to superheaters 22 and from there flows to its ultimate point of use.

Looking now to the combustion aspects of the furnace, fuel is burned on a traveling grate 24. The grate travels in a counter-clockwise direction by being driven from the forward shaft 26. The speed at which the grate travels will be set so as to obtain as complete combustion of the fuel as possible, depending on the makeup of the fuel, and the size of the fuel particles. The ash is discharged from the end of the grate through discharge chute 28.

Bark is fed to the furnace from a storage bin 30, through a rotary star valve 32 or other metering device. The bark falls by gravity through duct 34 and is then blown into the furnace by air from a plurality of high pressure air jet nozzles 36 which are equally spaced across the width of the furnace. The air velocity is adjusted such that the bark is distributed along the entire length of the traveling grate with a portion of it striking the baffle plate 40 before sliding down onto the upper grate run 42. Air to support combustion of the fuel is introduced through openings 44 beneath the grate, so as to flow upwardly through openings in the upper grate run 42. Overfire air is supplied to the furnace through ports 45.

The combustion gases leaving the furnace pass through an air heater 46 before being exhausted to the atmosphere. These combustion gases carry a large amount of char and ash in them, some of which is separated out of the gas stream and falls into hopper 48. Most of these particles are char. Star valve 50 permits these particles to pass into pipe 52 for reinjection into the furnace. More solids are separated out of the gases in a second hopper 54. At this point a large percentage of the solids are ash, in addition to the char. Thus star valve 56 discharges this mix to an ash-char separator 58 where the ash is separated from the char in any well known manner, for example by a size separating procedure (the ash particles being finer). The char particles flow through pipe 52 from the two hoppers to a plurality of inlet nozzles 60, which are equally distributed across the width of the unit so as to reinject these char particles 62 into the furnace on to the upper run 42 of the grate. This reinjection is done under the baffle 40. As can be seen, the char particles 62 will be covered by a layer of newly injected raw bark 64 as the upper run moves out from beneath the baffle 40. Thus the char particles, which are fairly light in comparison to the raw bark pieces, are prevented from being reentrained in the air flow up through the grate run. This permits these char particles to be completely combusted so as to substantially eliminate the continuous recirculation of char particles in the unit, which increases the overall efficiency of the unit. Pressurized air from pipe 70 can be used to move the char particles through pipe 52 into the furnace.

I claim:

1. In combination, a furnace for burning cellulosic fuel therein, a traveling grate in the furnace bottom having an upper run and a lower run, and also having a first end positioned adjacent a first wall of the furnace, and a second end located adjacent a second opposite wall of the furnace, a discharge chute located beneath the second end of the traveling grate through which ashes fall, means for continuously moving the upper run of the grate towards the second wall, inclined baffle means extending outwardly and downwardly from the first wall so as to extend above a portion of the first end of the traveling grate, means for introducing raw cellulosic fuel into the furnace in such a manner that part of it lands on top of the baffle means, sliding down onto the upper run, means for separating char particles out the combustion gases leaving the furnace, means for introducing said char particles onto the upper run of the grate at a location beneath the baffle means, so that as they move from beneath the baffle means they are covered with a layer of cellulosic fuel sliding down off the baffle means, thus preventing the relatively light char particles from becoming reentrained in the combustion gases flowing upwardly through the furnace before they are completely combusted.

* * * * *